United States Patent [19]

Ehret et al.

[11] 3,942,286

[45] Mar. 9, 1976

[54] HINGED WINDOW WITH QUICK RELEASE BAR

[75] Inventors: Yale W. Ehret; Robert A. Frey, both of Elkhart, Ind.

[73] Assignee: The Adams & Westlake Company, Elkhart, Ind.

[22] Filed: Sept. 16, 1974

[21] Appl. No.: 505,968

[52] U.S. Cl. ..... 49/141; 49/278; 49/394; 292/241; 292/103

[51] Int. Cl.[2] ..... E05B 65/10

[58] Field of Search ..... 49/141, 275, 276, 278, 49/394; 292/DIG. 33, 241, 107, 101, 102, 109, 202, 209, 163

[56] References Cited

UNITED STATES PATENTS

| | | | |
|---|---|---|---|
| 1,772,177 | 8/1930 | Dake | 49/278 X |
| 2,015,448 | 9/1935 | Esser | 49/278 X |
| 2,830,843 | 4/1958 | Seaburg et al. | 49/141 X |
| 3,431,677 | 3/1969 | Ehret et al. | 49/141 |
| 3,432,967 | 3/1969 | Simon | 49/394 X |

FOREIGN PATENTS OR APPLICATIONS

| | | | |
|---|---|---|---|
| 856,772 | 12/1960 | United Kingdom | 49/141 |
| 934,318 | 8/1963 | United Kingdom | 292/163 |

*Primary Examiner*—Kenneth Downey
*Attorney, Agent, or Firm*—Guy A. Greenawalt

[57] ABSTRACT

A window construction which is characterized by a sash frame hingedly mounted at the top of an opening in a generally vertical wall and provided with a latching mechanism comprising keepers on the inside face of the wall adjacent the bottom of the wall opening and a combination latch engaging and release bar pivotally mounted on the bottom of the sash frame so as to be swung into keeper engagement when the sash frame is hinged to closed position and to be readily swung to a position where the sash frame is released for opening movement.

6 Claims, 8 Drawing Figures

FIG. 4
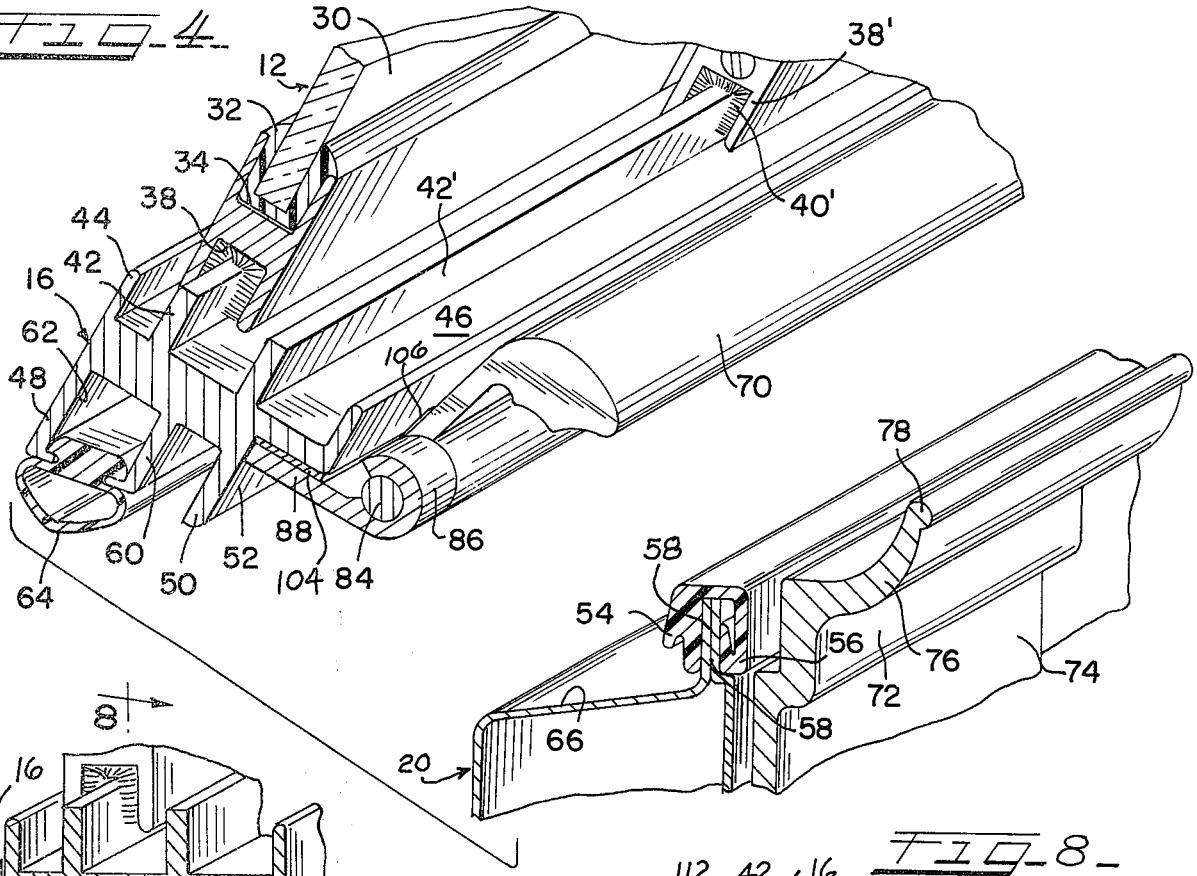
FIG. 8
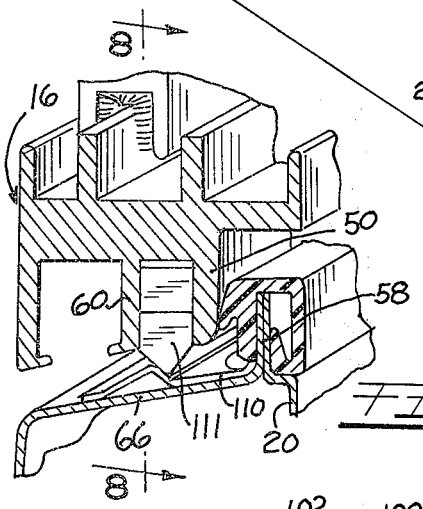
FIG. 7
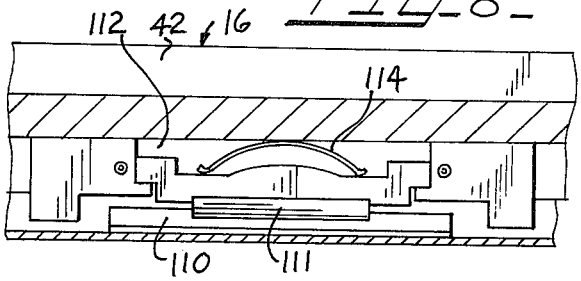
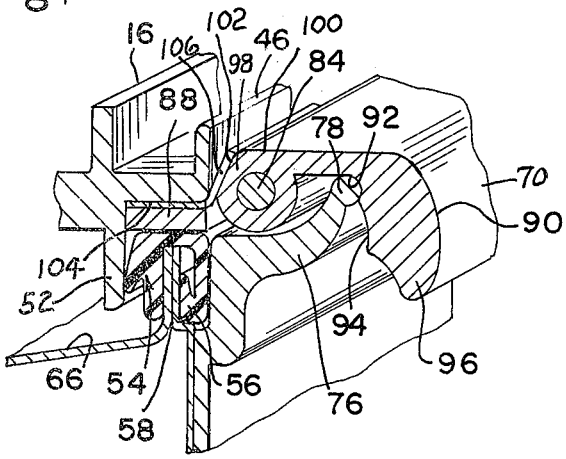
FIG. 5
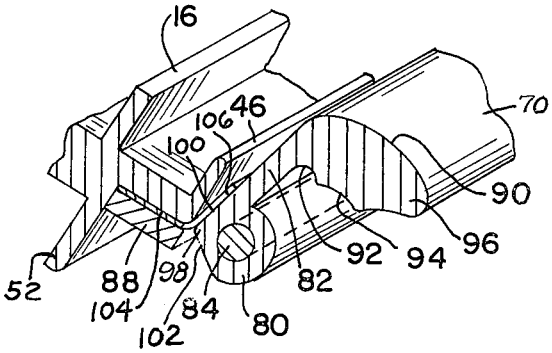
FIG. 6

HINGED WINDOW WITH QUICK RELEASE BAR

This invention relates to window constructions and is more particularly concerned with improvements in a hinged window mounting of the type which includes a latch arrangement for holding the window in a closed position in a supporting frame while enabling the window to be released for swinging to an open position.

Window constructions have been proposed heretofore for vehicles, such as, busses or the like, having passenger accommodating enclosures wherein provision has been made for normally holding the glass frame or sash in a closed position in a mounting frame and for enabling the sash latching or locking means to be disengaged so as to permit the window to be opened. In most of the prior arrangements the sash has been held with a latch or lock mechanism of conventional design. Generally, such arrangements have not been entirely satisfactory because the lock operating mechanism has not been fully accessible for operation, its operation has not been apparent to the prospective user or it has been difficult to manipulate so that valuable time may be lost in searching for the device or in manipulating the device when it is found. It is a general object of the invention, therefore, to provide a window construction wherein a sash is mounted in a supporting wall frame with a readily releasable latch arrangement which may be quickly found and easily operated so as to enable release of the sash for opening movement with minimum loss of time and little effort.

A more specific object of the invention is to provide an improved window construction which is especially adapted for mounting in the wall of a vehicle, such as, a passenger bus, or the like, wherein the sash frame is hinged so as to permit it to swing to an open position and a latch mechanism is provided which will securely retain the sash in a closed position in the mounting frame while enabling a quick release of the sash for opening movement by operation of a swingable release bar which is disposed on the inside of the sash frame where it is readily accessible for operation.

A further object of the invention is to provide a window construction for mounting in the wall of a passenger bus, or similar location, which comprises a sash frame hingedly mounted at the top for outward swinging movement and having a quickly releasable fastening device at the bottom for holding the sash frame in closed position in a mounting frame, which fastening device includes a latch operating bar member pivotally mounted on the sash frame and accessible for quick operation from a position near an inside face of the mounting frame.

A still further object of the invention is to provide a window construction for mounting in an opening in a generally vertical wall which comprises a sash frame hinged at the top for outward swinging movement and a latch mechanism at the bottom which is readily accessible for operation from a position adjacent an inside face wherein the latch mechanism includes an elongate release bar pivotally mounted on the bottom of the sash frame and engageable with a wall supported keeper member mounted adjacent the bottom of the opening in which the sash frame is hinged.

Another object of the invention is to provide a window construction which comprises a sash frame hingedly mounted in the top of an opening in a generally vertical wall and a quickly releasable fastening mechanism at the bottom of the sash frame which includes a pivoted latch bar on the sash frame and a wall mounted, co-operating keeper at the bottom of the opening with the latch bar held in either keeper engaging or non-engaging position by a single spring member.

These and other objects and advantages of the invention will be apparent from a consideration of the form of the invention which is illustrated in the accompanying drawings wherein:

FIG. 4 is a cross sectional, perspective view, to an enlarged scale, showing a portion of the sash frame assembly and the mounting frame with the sash in closed position, the view being taken on the same plane as in FIG. 3;

FIG. 5 is a fragmentary cross sectional view, to an enlarged scale, the view being taken on the plane indicated at 5—5 in FIG. 1 and showing the mechanism for holding the release bar in operative or latch engaging position;

FIG. 6 is a view similar to FIG. 5 showing the release bar held in non-operative or open position;

FIG. 7 is a fragmentary, cross sectional view similar to FIG. 5 showing a releasable stop or secondary latch which may be used with the window; and FIG. 8 is a fragmentary section taken on the line 8—8 of FIG. 7.

Figure 1:
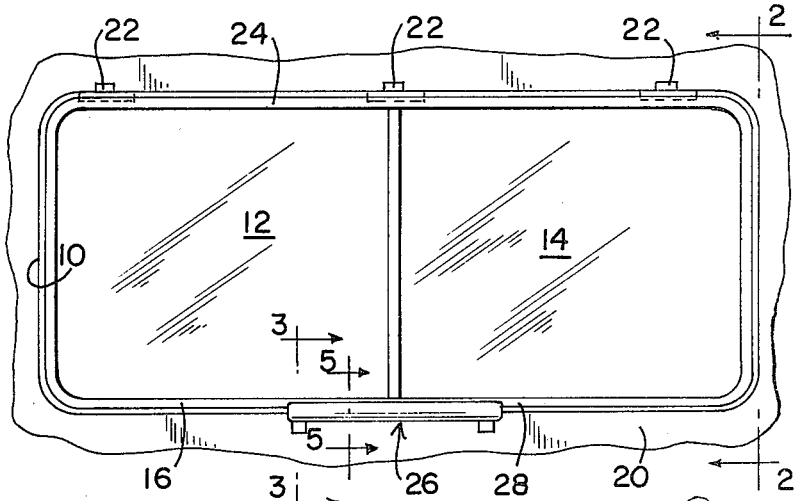
FIG. 1 is an elevational view showing the inside face of a hinged sash mounted in an opening in a supporting wall, which embodies the features of the invention.
Figure 2:
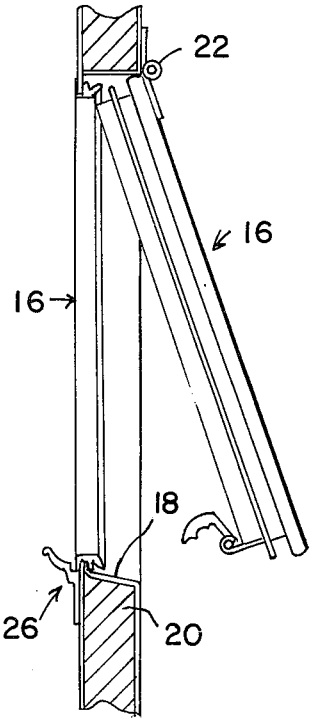
FIG. 2 is a sectional view taken on the plane indicated at 2—2 on FIG. 1.

Referring first to FIGS. 1 and 2 of the drawings, there is illustrated a window construction which incorporates the principal features of the invention. In the form illustrated the window comprises a sash frame assembly 10 which has mounted therein a pair of glass panel assemblies 12 and 14 which are slidably supported in the outer frame 16, with the latter being of generally rectangular shape. The sash supporting frame 16 is mounted for outward swinging movement in the opening 18 in a vertically disposed supporting wall such as, for example, the side wall 20 of a bus or other passenger vehicle, or the like, by means of a set or hinge members 22 spaced along the top rail 24 of the sash frame 16 and the top edge of the opening 18. Mechanism constituting a latching means 26 is mounted for co-operation on the bottom rail 28 of the sash frame 16 and adjacent the bottom edge of the wall opening 18.

In the form of window construction illustrated, the glass panel assemblies 12 and 14 each comprise a pane of glass 30, 30′ (FIGS. 3 and 4) with the margins thereof seated in a glazing gasket 32, 32′ in the glass receiving inwardly opening recess 34, 34′ of a peripheral frame member 36, 36′, the top and bottom rail portions of which have an H-shaped cross section with outwardly facing recesses 38, 38′ which are provided with a suitable weather seal 40, 40′ and which receive inwardly extending, parallel, spaced rail members 42, 42′ on the support frame 16. The rail members 42, 42′ are spaced from inner and outer side edge flanges 44, 46 which extend inwardly of the frame 16 in parallel planes, and define part of the inner and outer faces of the frame 16 while co-operating with the rail members 42, 42' in forming inwardly opening guideway recesses in which the sash panel assemblies 12 and 14 may travel.

Figure 3:
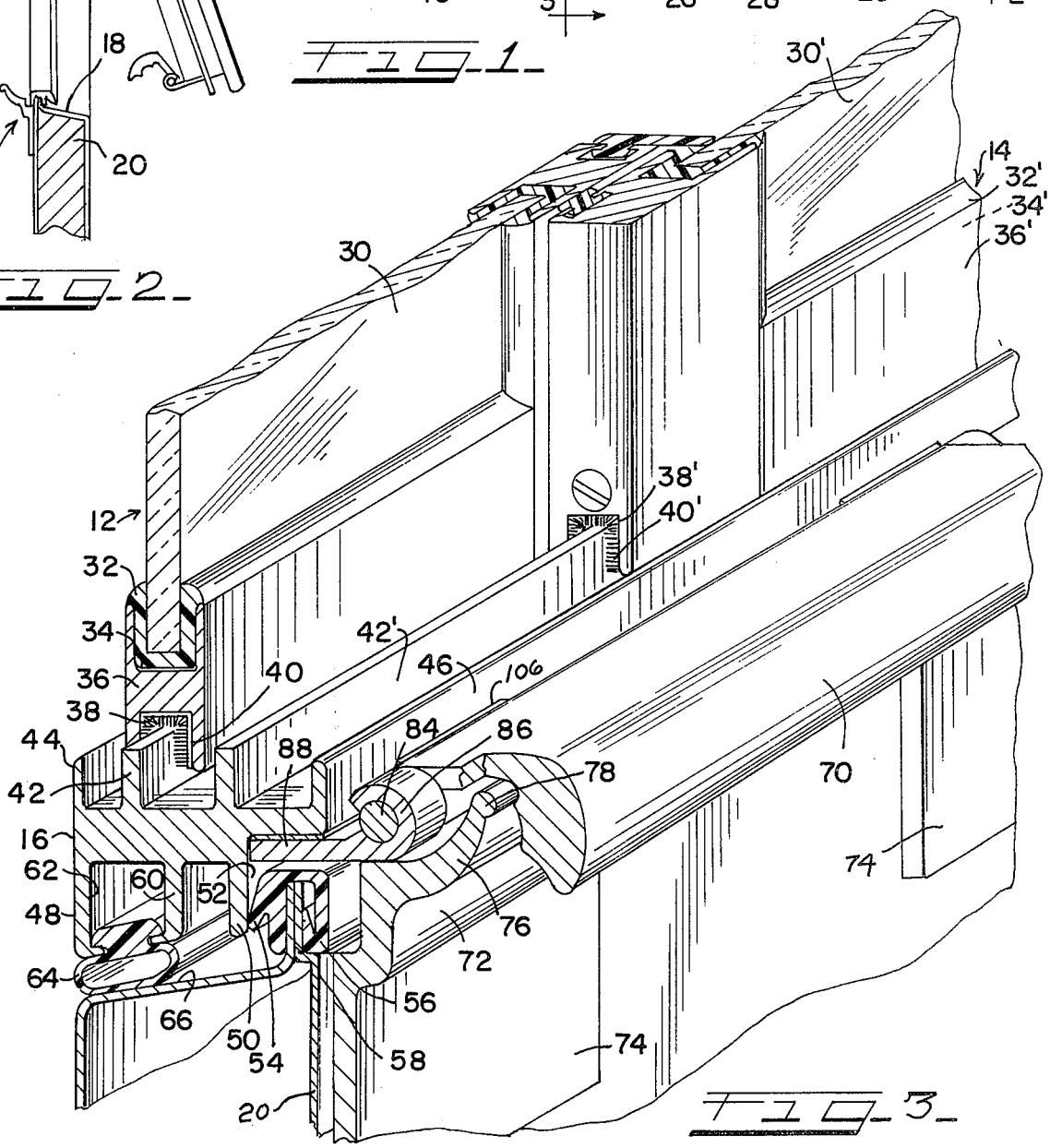
FIG. 3 is a cross sectional, perspective view, to an enlarged scale, showing a portion of the sash assembly and mounting frame with the view being taken on a plane extending through the release bar and indicated at 3—3 on FIG. 1 and with the sash in closed and latched position.

The frame member 16 has outwardly directed side edges flange formations 48 and 50 which extend in parallel planes. The flange 50 is in a plane offset relative to the inner face flange 46 so as to provide a surface 52 for sealing engagement with the lip forming bead 54 on a primary sealing gasket 56 which is seated on the flange-like marginal wall portion 58 which defines the opening 18 in which the window is mounted. The wall portion 58 on which gasket 56 is mounted is in a plane offset outwardly of the inside surface of the wall 20 so as to make it difficult for an unauthorized person to get beneath the bottom edge of the gasket 56 and pry off the same. The side edge flange 48 co-operates with the flange 44 in forming the outside face of the frame 16 and also co-operates with a center rib formation 60 in forming a continuous, outwardly opening edge recess 62 in which there is seated a bulb-type sealing gasket 64, the arrangement being such, that, when the frame 16 is in the closed position, as shown in FIG. 3, gasket 64 engages the surface 66 which extends outwardly of the gasket carrying flange 58 and also surrounds the opening 18 in the form of a ledge facing in the direction of the sash elements.

The latch assembly 26 comprises an elongate bar member 70 which is pivotally mounted on the bottom of frame 16 and which is operable manually for latching engagement with keeper forming members 72 secured on the inner face of the wall 20. The keeper members 72 are spaced along the wall 20 and positioned adjacent the ends of the bar member 70. Each keeper member 72 comprises a base plate portion 74 for mounting on the inside face of the wall and a top marginal portion shaped to provide an upwardly and outwardly curved portion 76 terminating in a top edge bead formation 78. The bar member 70, which constitutes a latching and release bar, has a barrel formation 80 (FIGS. 5 and 6), at one edge of a plate-like portion 82, which barrel formation receives a pivot forming pin 84 having its ends extended and received in hinge leaf formations 86 (FIGS. 3 and 4) at opposite ends of a mounting plate 88. The mounting plate 88 is secured by welding or other suitable means to a bottom face portion of the bottom rail on frame 16.

A curved portion 90 of the release bar 70, having an enlarged cross section, extends along the free edge margin of plate portion 82, in a plane approaching a right angle with the plane of the plate portion 82. The curved portion 90 is provided on its inner or under face with a pocket forming recess 92, at the junction with the plate portion 82, which recess 92 is shaped to receive the bead 78 on the edge of the keeper member 72. Adjoining the bend 78 there is a somewhat curved cam surface area 94 for engaging the bead 78 in pivoting the bar member 70 to a fully closed, latch engaged or locked position. The cam surface 94 terminates short of a rounded edge portion 96 which the operator may grip in swinging the release bar 70 toward an opening position.

The release bar 70 has a tail portion 98 with one face 100 which is a marginal portion of the top face of the plate portion 82 and another face 102 in a plane approximately at right angles to the plane of the face 100. A spring plate 104 is mounted by welding or other fastening means on the frame 16, preferably between the plate 88 and the frame surface as shown in FIGS. 5 and 6, which has a bent free marginal portion 106 positioned to engage the tail portion 98 on the release bar 70. In the closed position of the window the spring portion 106 engages the tail surface or face 102, as shown in FIG. 5, while in the open position of the window the release bar 70 is held in non-operative position, as shown in FIG. 6, by engagement of the spring portion 106 with the tail surface or face 100. When the bar 70 is swung it operates between the two positions with a snap action.

In the operation of the window, which is normally held by the latch mechanism 26 in a closed position in the opening 18, the release bar 70 may be quickly flipped to an open or release position by grasping the bar manually and lifting it out of engagement with the keeper beads 78. When the window is swung to a closed position it may be quickly latched by swinging the release bar 70 downwardly into engagement with the keeper beads 78.

An additional feature which may be incorporated in the window construction is shown in FIGS. 7 and 8. A keeper member in the form of a ribbed plate 110 is fixed on the shelf surface 66 of the opening where it is engaged by the beveled end of a spring pressed latch bolt member 111 which is housed in slidable relation in a pocket 112 in the recess or elongate groove 113 in the sash frame 16 when the sash frame 16 is swung to the closed position. The recess 113 is formed between the frame flange member 50 and rib member 60 and the bolt member 111 is backed by a spring member 114 seated in the recess 112. This provides a releasable stop or holding member for the frame 16 and prevents the frame from swinging open immediately when the release bar 70 is pivoted to released position. It reduces the possibility of damage when there is a high wind or the like. This secondary holding means is readily overcome by outward pressure on the opened release bar.

Only so much of the detail of the sliding sash and frame construction is illustrated and described as is deemed necessary for an understanding of the invention. It will be understood that details not referred to are conventional and that the sliding sash construction is illustrative only of the general type window in which the invention may be embodied. The invention may be incorporated in a single pane or other sash construction which may be supported for outward swinging movement. Also, the sash frame 16 may be hinged at the side or at the bottom with the release mechanism mounted on the side of the frame and opening opposite the hinge mounting.

We claim:

1. A window construction which comprises a sash which includes a generally rectangular glass panel supporting sash frame of a size for closing an opening in a generally vertical wall, means at the one side of said opening mounting said sash frame for swinging movement in a direction outwardly of said opening, and a latch assembly for releasably holding the sash in the opening when the sash is in a closed position, which latch assembly includes a keeper member mounted adjacent the edge of the opening which is opposite said sash mounting means, said keeper member being in the form of an elongate plate member with a bead forming top edge portion extending along the inside edge of said opening and inwardly of said opening, and an elongate latch engaging and release bar which is pivotally mounted on the edge of said sash frame and which has on its bottom face surface portions positioned for engaging said bead edge portion of said keeper member whereby upon closing said sash said release bar is accessible for manual operation on the inside of said wall and may be swung to engage said bead edge portion and draw said sash into tight engagement in said opening.

2. A window construction as set forth in claim 1 wherein said latch engaging and release bar has a bottom face with a downwardly facing groove disposed for engaging therein said bead forming top edge portion of said keeper member so as to hold said sash frame in the closed position while permitting ready release for opening thereof by upward swinging movement of said latch engaging and release bar.

3. A window construction as set forth in claim 1 wherein said latch engaging and release bar has a downwardly facing bottom surface with a downwardly opening groove for engaging therein said beaded edge portion of said keeper member and an adjoining, downwardly facing cam surface for engaging said beaded edge portion of said keeper member so as to assist in drawing the sash into tightly closed position in the opening and in seating said beaded edge portion in the co-operating groove in said bar.

4. A window construction as set forth in claim 1 wherein said latch engaging and release bar is pivotally mounted along an edge thereof by means of a pivot rod which is mounted in parallel and spaced relation to an inner face portion of said sash frame, and said pivotal mounting rod has associated spring means for resiliently holding said bar selectively in keeper engaging position and in sash releasing position.

5. A window construction as set forth in claim 1 wherein a secondary latch and stop assembly is mounted in part on said ledge formation and in part on said sash frame which latch assembly is engagable when said sash frame is moved to the closed position and is readily disengaged by outward pressure on said sash frame when said release bar is operated so as to release said sash frame for outward swinging movement.

6. A window construction which comprises a pane carrying sash frame of generally rectangular shape mounted in a rectangular opening in a wall which is disposed in a generally vertical plane, said opening being defined by a flange formation and an outwardly extending ledge formation with a continuous primary weather sealing element, means hingedly mounting said sash frame at one side of the opening for outward swinging movement and having an inner face portion for engaging said primary sealing element and carrying a continuous, peripheral, secondary weather seal element for engaging said ledge formation, and a latch assembly disposed at the side of said sash frame and said opening which is opposite the hinged mounting for holding said sash frame in closed and sealed position in said opening, which latch assembly includes an elongate, manually operable release bar which is pivotally mounted along one edge thereof on said sash frame and a co-operating keeper member mounted on the inside face of said wall adjacent said opening and which is accessible on the inside of said wall for quickly releasing said sash frame so as to permit outward swinging movement thereof, said keeper member having a projecting portion in the direction of the opening with a bead-like edge and said release bar having a curved face in the opposite direction with a groove positioned to receive said keeper edge and an adjoining cam surface extending therefrom which is adapted to engage said keeper edge in drawing the sash to fully closed position, said release bar having an associated spring means operable to selectively hold said release bar in keeper engaging or non-engaging position.

* * * * *